United States Patent [19]

Richards

[11] Patent Number: 4,869,086

[45] Date of Patent: Sep. 26, 1989

[54] BLOCKING DEVICE FOR LATCH MECHANISM

[76] Inventor: Robert M. Richards, 3223 Etude Drive, Malton, Ontario, Canada, L4T 1S9

[21] Appl. No.: 152,231

[22] Filed: Feb. 4, 1988

[30] Foreign Application Priority Data

Oct. 19, 1987 [CA] Canada ..... 549662

[51] Int. Cl.[4] ..... E05B 13/00

[52] U.S. Cl. ..... 70/416; 70/210

[58] Field of Search ..... 70/416, 207, 209, 210; 292/336.3, 347, DIG. 2

[56] References Cited

U.S. PATENT DOCUMENTS

| | | | |
|---|---|---|---|
| 2,463,195 | 3/1949 | Mungan | 70/416 |
| 3,423,974 | 1/1969 | Bernsley | 70/416 |
| 4,279,137 | 7/1981 | Cook | 70/416 |
| 4,404,826 | 9/1983 | Brill | 70/416 |

*Primary Examiner*—Robert L. Wolfe

*Attorney, Agent, or Firm*—Ivor M. Hughes

[57] ABSTRACT

A repositionable latch blocking apparatus for use with a latchable mechanism, the latchable mechanism having an operating device to operate the latchable mechanism between locked and unlocked positions, the latch blocking apparatus including a unitary configuration having at least a first surface, the unitary configuration having a fastening device disposed thereupon adjacent the operating device in use, to fasten the latch blocking apparatus proximate the operating device of the latchable mechanism, so as to position the at least first surface to block the operation of the operating device and thereby prevent the operation of the latchable mechanism between locked and unlocked positions, whereby when the latch blocking apparatus is repositioned, so as to position the at least first surface remote the operating device said repositioning allows operation of the latching mechanism.

16 Claims, 3 Drawing Sheets

FIG.1.
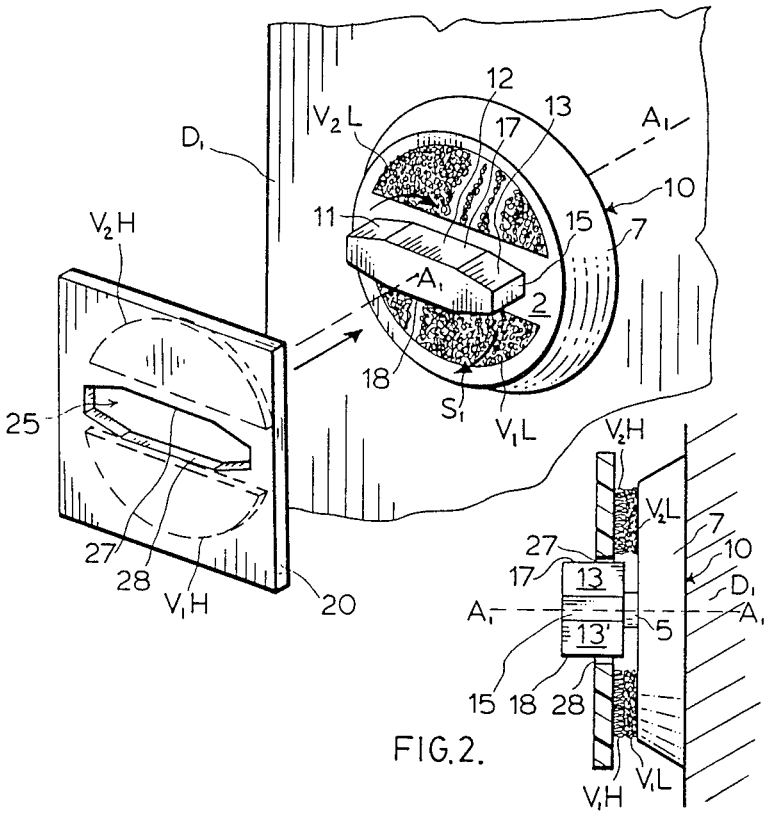
FIG.2.
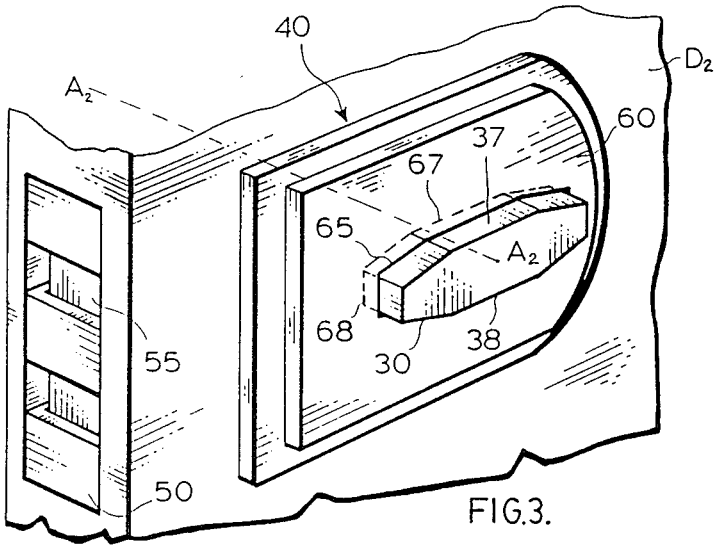
FIG.3.

FIG.10.
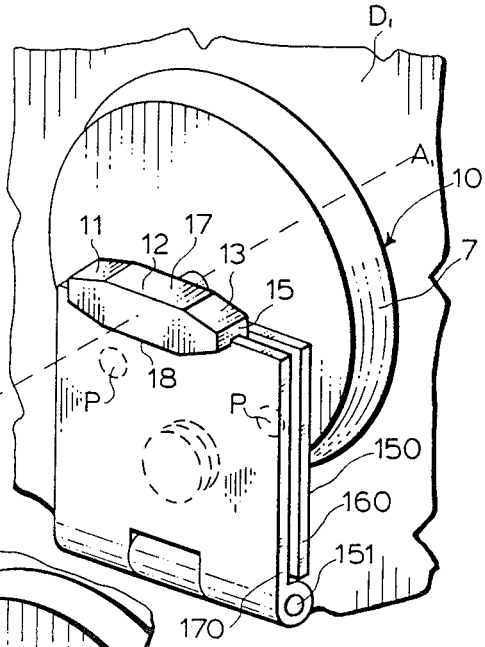
FIG.11.
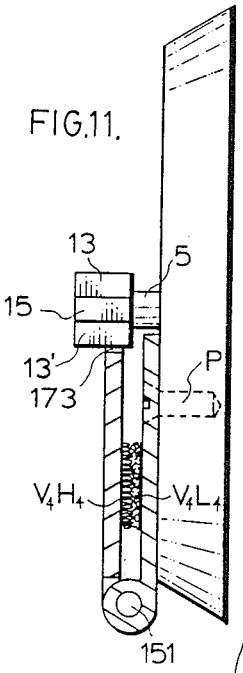
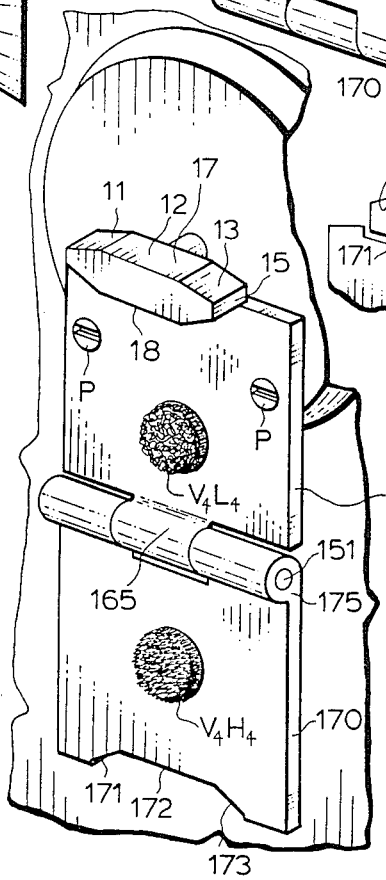
FIG.12.
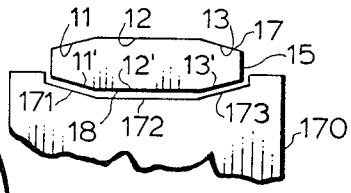
FIG.13.

BLOCKING DEVICE FOR LATCH MECHANISM

FIELD OF INVENTION

This invention relates to latch mechanisms and specifically to blocking devices which prevent the rotation of the operating means of latch mechanisms, from a locked to an unlocked position and vice versa.

BACKGROUND OF INVENTION

A multitude of security devices exists within the prior art which teach the use of supplementary devices in conjunction with a typical latching arrangement for preventing undesirable access to one's premises. Examples of such devices are supplementary chains, dead bolts and latches.

U.S. Pat. No. 4,484,463 issued on Nov. 27, 1984 by Hennessy describes a door lock guard for protecting the cylinder of a door lock upon the key cylinder side. Such door lock is permanently mounted as best illustrated in FIG. 3 by fastening elements 46. The shape of portion 18 of plate 12 formed from the appropriate materials ensures that the cylinder 34 cannot be accessed by a tool and subsequently rotated.

U.S. Pat. No. 4,074,552 describes a kit which adapts to a lock preventing tampering of the lock thus undesirable access to one's premises. Such a combination is accessible only by a special long key which will turn the cylinder of the lock.

U.S. Pat. No. 3,556,571 by Laub issued Jan. 19, 1971 describes a device for attachment to a door knob which in essence child proofs the door knob and prevents rotation of the lock bolt of a door until such time as an adult removes the attachment. The instant invention provides a number of alternative embodiments of a latch blocking element which is installed upon the interior of a door proximate the operating means of a door latch and thus prevents the rotation of the operating means in use until such time as the blocking device is repositioned. The blocking device thus prevents the rotation of the for example a key cylinder in a household door. Should the key cylinder be tampered with on the exterior of the door by an intruder, the rotation thereof would be prevented on the interior by blocking the rotation of the operating means connected to the key cylinder. Nowhere within the prior art is such a blocking means found which may be used by for example the occupant of a home as a night latch for securing his or her home.

It is therefore an object of this invention to provide a latch blocking mechanism which blocks the operation of operating means of a latching means thus preventing the rotation of the latching means from a locked to an unlocked position.

It is a further object of this invention to provide a blocking means embodied in alternative embodiments which co-operate with those latching means most broadly utilized in household latches. It is a further object of the invention to provide a latch blocking means which is easy to install, move, remove, or reposition.

Further and other objects of the invention will become apparent to a man skilled in the art when reviewing the following summary of the invention and the more detailed description of the preferred embodiments illustrated herein.

SUMMARY OF THE INVENTION

According to one aspect of the invention a repositionable latch blocking means is provided for use with latchable means, the latchable means having operating means to operate the latchable means between locked and unlocked positions, the latch blocking means comprising a unitary configuration having at least a first surface, the unitary configuration having fastening means disposed thereupon adjacent the operating means in use, to fasten the latch blocking means proximate the operating means of the latchable means, so as to position the at least first surface to block the operation of the operating means and thereby prevent the operation of the latchable means between locked and unlocked positions, whereby when the latch blocking means is repositioned, so as to position the at least first surface remote the operating means said repositioning allows the operation of the latchable means.

According to yet another aspect of the invention the latch blocking means may comprise a substantially planar element having an opening extending therethrough compatible with the operating means of the latching means. In a preferred embodiment the latch blocking means has first fastening means mounted thereupon proximate the opening for engagement with compatible second fastening means adjacent the operating means of the latching means. Preferably the fastening means comprises interlocking material segments such as "Velcro", (a Registered Trademark of Velcro Inc. of Manchester N.H., U.S.A.). In a preferred embodiment the latching means comprising a lock for a door.

According to yet another aspect of the invention the latch blocking means may comprise at least a first and second planar element hingeably connected together remote the operating means in use, the first element being fastened proximate the operating means of the latching means but not engageable with the operating means, the at least a second element having the at least a first surface of the latch blocking means and being pivotable from a position remote the operating means to a position proximate the operating means, the at least first and second elements having fastening means disposed proximate their adjacent surfaces, adjacent when the at least a second element is pivoted to a position proximate the operating means, thereby engaging the at least a first surface and the operating means until such time as the at least a second element is pivoted away from the operating means. Preferably the fastening means comprises interlocking material segments such as "Velcro" (a Registered Trademark of Velcro Inc. of Manchester N.H., U.S.A.). In a preferred embodiment the latching means comprising a lock for a door.

According to yet another aspect of the invention, the latch blocking means may comprise a substantially frustum shaped element preferably having an opening disposed in the surface of the end of the element having the smaller diameter, the at least first surface being of compatible shape to engage the operating means of the latching means and thereby block the operation of the operating means until the latch blocking element is repositioned remote the operating means, the latch blocking means having first fastening means disposed about some of the surface area of the frustum shaped element, the first fastening means for engagement with second fastening means disposed proximate the operating means to maintain the blocking element in position, whereby the at least first surface of the blocking element and preferably the opening disposed in the surface of the end of the element having the smaller diameter, blocks the operation of the operating means of the latching means until such time as the at least first surface of the blocking element and preferably the opening are repositioned remote the operating means. Preferably the fastening means comprises interlocking material portions such as "Velcro" (a Registered Trademark of Velcro Inc. of Manchester N.H., U.S.A.). In a preferred embodiment the latching means comprises a door knob having a centrally disposed rotatable operating means for locking and unlocking a door.

According to yet another aspect of the invention, the latch blocking means may comprise a substantially convex disc shaped element preferably having an opening disposed in the surface of the end of the element having the convex shape, the at least first surface being of compatible shape to engage the operating means of the latching means and thereby block the operation of the operating means until the latch blocking element is repositioned remote the operating means, the latch blocking means having first fastening means disposed about some of the surface area of the convex disc shaped element, the first fastening means for engagement with second fastening means disposed proximate the operating means to maintain the blocking element in position whereby the at least first surface of the blocking element and preferably the opening disposed in the surface of the end of the element having the smaller diameter, blocks the operation of the operating means of the latching means until such time as the at least first surface of the blocking element and preferably the opening are repositioned remote the operating means. Preferably the fastening means comprises interlocking material portions such as "Velcro" (a Registered Trademark of Velcro Inc. of Manchester N.H., U.S.A.). In a preferred embodiment the latching means comprising a door knob having a centrally disposed rotatable operating means for locking and unlocking a door.

BRIEF DESCRIPTION OF THE DRAWINGS

FIG. 1 is a perspective view of the latch blocking means about to be installed upon a latched lock in a preferred embodiment of the invention.

FIG. 2 is a side view of the latch blocking means of FIG. 1 in a preferred embodiment of the invention.

FIG. 3 is a perspective view of a latch blocking means in an alternative embodiment of the invention.

FIG. 10 is an alternative embodiment of the invention to that illustrated in FIG. 1.

FIG. 11 is a side view of the alternatively embodied latch blocking mechanism of FIG. 10.

FIG. 12 is a perspective view of the same embodiment of the instant invention as FIG. 10 wherein the blocking surface is remote the operating means.

FIG. 13 is a front view of the blocking surface of the latch blocking mechanism in its relationship to the operating means of the latch.

DETAILED DESCRIPTION OF THE PREFERRED EMBODIMENTS

Figure 4:
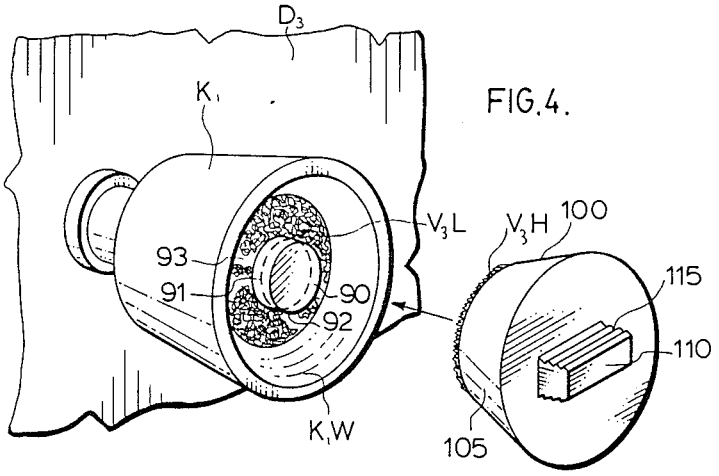
FIG. 4 is a perspective view of a latch blocking means in an alternative embodiment of the invention.

Referring now to FIG. 1 wherein a latch 10 is illustrated installed within a door D1. The door D1 is a typical door found within a typical household. The latch 10 is a typical latch as illustrated found within a household having a key cylinder disposed upon the other side of door D1 (not illustrated). The key cylinder is connected to the operating handle 15 of the latch mechanism 10; operating the operating means from a position as illustrated being substantially horizontal to a position substantially normal to that illustrated, will as well known in the art, latch and unlatch the latch mechanism 10, thus allowing the occupant of a room or household to block their door. Installed upon latch mechanism 10 upon the outer surface 2 thereof, are two arcuate segments V1L and V2L. Said segments may be installed by gluing or alternative fastening to the surface 2. It is recommended that the gluing or fastening of the arcuate segments be accomplished with high strength glue or fastening compounds. The arcuate segments V1L and V2L will not interfere with the operation of the operating handle 15 as long as blocking element 20 is not inserted around operating handle 15 while operating handle 15 is in the horizontal position illustrated in FIG. 1. Blocking element 20 is structured in a substantially rectangular shape and having a thickness which is variable depending on the material used to embody the blocking elements. In one embodiment, the blocking element is manufactured from a clear acrylic and thus having a thickness which is considerably thicker than if the blocking element 20 were manufactured from metal. Extending through the blocking element 20 is a slot 25 bounded by internal surfaces 27 and 28, the slot thus taking the shape of the operating handle 15 but being a predetermined amount larger in dimentions to operating handle 15, thus allowing the snug fit of the blocking element 20 about the operating handle 15. Disposed upon the outer surface of the blocking element which will abut surface 2 in use, are arcuate portions V1H and V2H disposed on the side of the notch so as to compatibly mate with V1L and V2L segments when the blocking element is positioned over the operating handle 15. In the preferred embodiment the segments V1L, V2L, V1H and V2H are compatible "Velcro"-type segments (Velcro being a Registered Trademark of Velcro Inc. of Manchester N.H., U.S.A.). It is, of course, understood that any convenient fastening arrangement can be used which provides the strength to fasten the blocking element 20 in a temporary position proximate operating handle 15 in use, and further allows the removal of the blocking element 20 when desired.

Referring now to FIG. 2, the blocking element 20 is illustrated in side view installed upon the latch of FIG. 1 wherein the operating mechanism 15 is in a substantially horizontal position, thus allowing the user to insert the blocking element 20 around the operating handle 15, whereby the operating handle 15 will not turn in spite of the operation of the key cylinder to which it is in communication (not shown), because of the fastening portions V1H, V1L and V2H, V2L being in fastening engagement such that the hooks V2H and V1H are fastened to the loops V2L and V1L. In determining the surface area to be covered by arcuate segments preferably manufactured from "Velcro", it is important to ascertain the amount of torque developed when a key is operated by an individual about a central axis Al extending through the latch toward the key cylinder. Such a twisting load as operated by a conventional key must present less mechanical advantage than the resistance of the blocking element upon surfaces 27 and 28 against surfaces 18 and 17 respectively of the operating handle. By distributing the load about a greater surface area, such resistance is accomplished, thus preventing the rotation of the operating handle 15 and thus the latching mechanism 10. Of course, it is more probable that the intruder would not have a key and would be attempting to jimmy the lock with a screw driver or alternative tool. The instant invention will, of course, work satisfactorily providing that the force used to turn the key cylinder is less than the resistance available as presented by blocking element 20. In alternatives when the "Velcro"-type fastening would not work satisfactorily, it is recommended that mechanical fasteners be used to prevent the rotation of the cylinder. Such fasteners may be pins or threaded pins which accept wing nuts allowing the removal of the blocking element 20. It is also conceivable that the device may be held in place by re-useable tapes, screws or any other fastener that would function properly.

Referring now to FIG. 3, an alternative embodiment of the blocking element 20 in FIG. 1 is illustrated as element 60 blocking an operating handle 30 in the same manner as discussed in relation to FIG. 1. Thus the lock bolt 55 is precluded from unlatching in relation to a striker plate (not illustrated) when cover plate 50 is proximate the striker plate, by the blocking element 60 when opening 65 encloses operating handle 30 wherein the top surface 67 and the bottom surface 68 abut the top surface 37 of the operating handle and the bottom surface 38 of said operating handle. Again the rotation of the key cylinder about the axis A2 will be restricted by the blocking element and a mechanical advantage presented by the abutting surfaces 67 and 68. Thus, latch mechanism 40 installed on door A2 will not operate until such time as the latch blocking element 60 is removed. Alternative fasteners again may be used to removeably fasten the blocking element adjacent the latching mechanism as illustrated.

Figure 5:
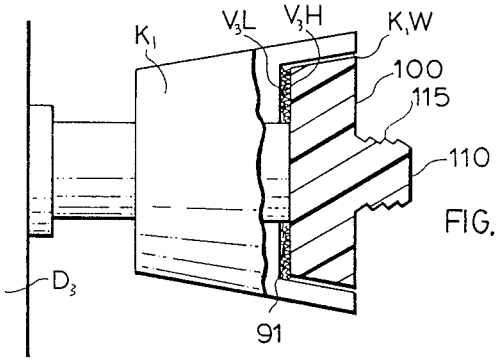
FIG. 5 is a side view of the latch blocking means illustrated in FIG. 4 in an alternative embodiment of the invention.

Referring now to FIGS. 4 and 5, an alternative embodiment of the instant invention is illustrated wherein a door D3 is latched by a latching mechanism disposed within said door being operated by a push button 90 operable from an unlatched position 92 to a latched position 91 and disposed centrally within the door knob K1, there being a compatible door knob on the other side of door D3 which has disposed therein in this alternative embodiment a key cylinder. As illustrated in FIG. 4, the button 90 is depressed to lock the latch and prevent unwanted entry. The door knob has a generally flat surface 93 upon which the loop portions of "Velcro"-fastening materials V3R are disposed. It is recommended that the "Velcro" loops be fastened to the surface 93 by gluing or alternative permanent fastening. The portion V3L is in essence a donut shaped portion in vertical cross section completely circumscribing the button 90. Disposed within the door knob is a surface K1W which may also be used to fasten the loop portions of "Velcro" fasteners to further improve the operation of the blocking element. This is not however illustrated in relation to FIGS. 4 and 5. The blocking element 100 is substantially frustum shaped, being of compatible shape with the opening defined by the surfaces K1W and 93, and having a diameter slightly smaller than the outside diameter of the surface 93. When the generally frustum shaped element 100 is inserted within the opening defined by the surfaces 93 and K1W, it will be held in place as best illustrated in relation to FIG. 5 by the portions V3H fastened to the outer surface of the element upon the portion of the frustum having a smaller diameter. A handle portion 110 is provided to enable the user to position the frustum element within the door knob. The handle 110 has ribbed portions 115 which allow the user to grip the said handle 110. Thus, the element 100 will by fastening itself to the door knob K1 via the compatible engagement of portions V3L and V3H disposed upon the door knob and the element respectively, will prevent the movement of the blocking pin 90 from the position 91 to the position 92. Therefore, if an individual using either a key or a prying device, attempts to rotate the key cylinder and thus the latching mechanism, the presence of the blocking element will strain the movement of said pin 90 and thus prevent the unlatching of the latch mechanism disposed within door 3. This is best illustrated in relation to FIG. 5. However, once an individual wishes to remove the blocking element 100, the door will be free to latch and unlatch as in normal operation. It is recommended, however, that the amount of "Velcro"-type fasteners used provides sufficient resistance to the movement of pin 90 so that any force exerted upon the blocking element 100 will be overcome by the resistance of the hooks V3H to remain fastened to the loop portions V3L.

Figure 6:
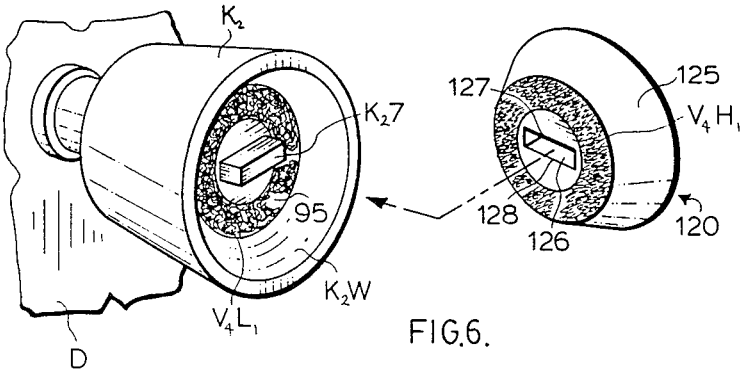
FIG. 6 is a perspective view of the latch blocking means in an alternative embodiment of the invention.

Referring now to FIG. 6, an alternative embodiment of the instant invention is illustrated being very similar in arrangement to that of FIGS. 4 and 5 but alternatively illustrating the use of a rotating handle K27 disposed within the door knob K2 attached to door D4. Again there are loop portions V4L1 disposed upon the surface 95 which will fasten with the hook portions V4H1 disposed upon the frustum shaped blocking element 120. The blocking element has a slot 126 disposed therein having an upper and lower surface 127 and 128 respectively. When the hook portions V4H1 are fastened to the loop portions V4L1, the opening 126 will surround the cylindrical operator K27 and prevent it from rotating as previously mentioned in relation to FIG. 1. The operation of the blocking mechanism 120 will be identical to the operation of the mechanism in relation to FIG. 1 with the exception of its shape being compatibly determined by the shape of the door knob interior defined by surfaces K2W and surfaces 95. It is of course possible that that shape be alternative configuration being slightly concave in shape, thus taking the blocking element which would be convex in shape as illustrated in relation to FIG. 7.

Figure 7:
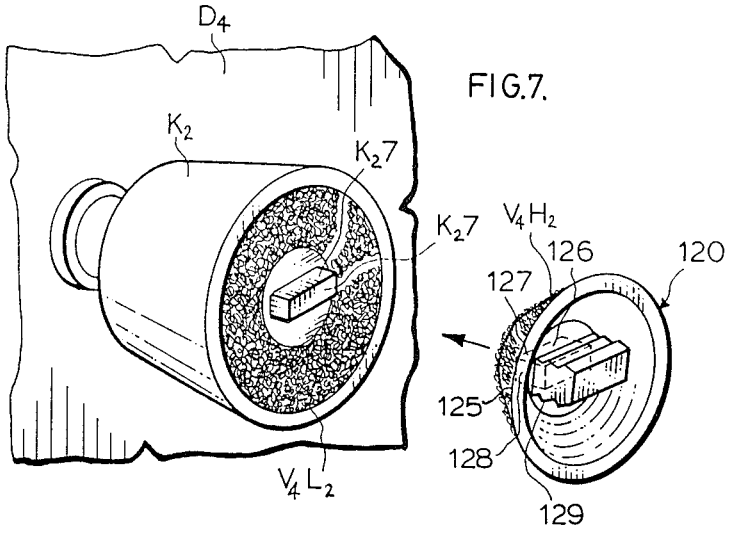
FIG. 7 is a further alternative embodiment of the latch blocking means illustrated in FIG. 6.
Figure 8:
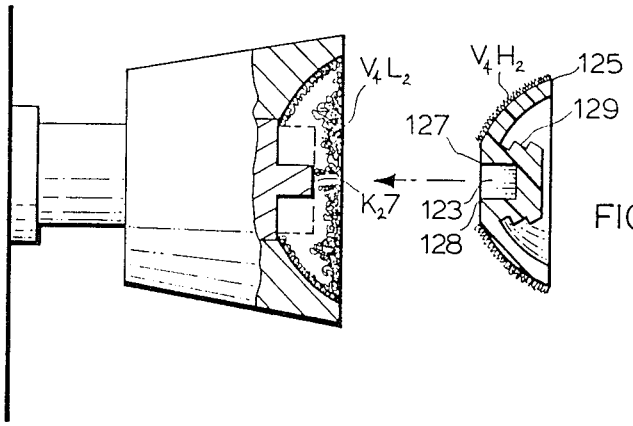
FIG. 8 is a side view of the unblocked latching means of FIG. 7 in an alternative embodiment of the invention.
Figure 9:
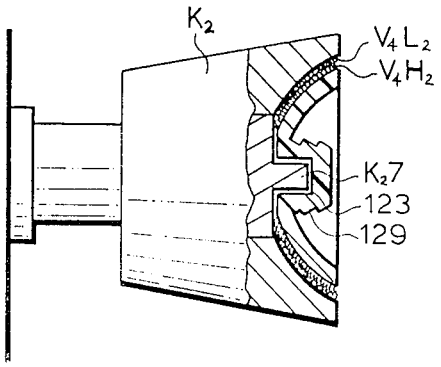
FIG. 9 is a side view of the blocked latching means of FIG. 7 in an alternative embodiment of the invention wherein the blocking means is installed.

Referring now to FIGS. 7, 8 and 9, the identical alternative embodiment is that illustrated in FIG. 6 is found, however, being slightly different in that the frustum shaped blocking element is replaced with a convex shaped disc element having in all other attributes identical features to those described in relation to FIG. 7. Thus, the door D4 has a door knob K2 having a crank handle found at the centre thereof K27, and having a disc shaped opening C disposed at the end of the knob proximate the operating lever K27. Disposed upon the concave surface C is "Velcro"-type loops V4L2 circumscribing the entire surface C about the operating lever K27. A compatibly shaped convex blocking element is provided having disposed upon its exterior convex surface a "Velcro"-type material V4H2 which will compatibly engage with the loops upon the door knob as described in relation to FIGS. 4 through 6. An opening 126 is disposed upon the side of the blocking element having the convex shape, said opening 126 being compatible with the operating lever K27 and having an upper and lower surface 127 and 128 respectively to block the movement of the handle K27 in use. Again, a ribbed portion 125 having ribs 129 is provided as a handle for the user. Thus, again the rotation of the handle K27 will be blocked by the blocking element 120 and thus prevent the unlatching of the latching mechanism within door D4 until such time as the disc shaped blocking element 120 is removed. Again, the amount of "Velcro" used must be sufficient to prevent the rotation of the handle K27 when the key or a prying device is used to turn the key cylinder. As in the case as described in relation to the preferred embodiment illustrated in FIG. 1, the resistance of the "Velcro" must be greater than the torque load applied to rotate the handle K27.

Referring now to FIGS. 10, 11, 12 and 13, an alternative embodiment of the blocking element is provided being situated upon the latch as described in relation to FIG. 1 but having an alternative form to that described in relation to FIG. 1. Thus, a door D1 has a latch operating portion 15 disposed centrally within a latch casing 10. The handle 15 is rotatable about an axis A1 as was the latch in FIG. 1. The blocking element 150 is thus provided having two primary components 160 and 170 as best illustrated in relation to FIG. 12. Portions 160 and 170 are hingeably connected by flanges 165 disposed within 160 and by 175 disposed within 170. A pin 151 passes through the opening formed within the flanges and thus allows for the fastening of members 160 and 170. Pins P pass through openings (not shown) to fasten the element 160 to the latch housing 10. Elements 170 and 160 are very similar in shape and appear to be symmetrical about the pin 151. However, when the blocking element 150 is installed upon the door latch housing 10 as illustrated in relation to FIG. 12, the operating handle 15 will not be interfered by in any way as best illustrated in relation to FIG. 11, thus the portion 160 is installed as illustrated in FIG. 11 to rest against the exterior of the housing 10 but not block the operation of the operating lever 15 until such time as the locking to FIGS. 10 and 11 wherein surfaces 171, 172 and 173 will abut the respective surfaces 11', 12' and 13' and thus prevent the rotation of the operating handle 15 as previously described in relation to FIG. 1. A "Velcro" patch is disposed upon the surfaces which abut in use of elements 160 and 170. The amount of "Velcro"-type material used or alternative fastening materials used will depend upon the weight of the element 170. Thus, the "Velcro" fastener is used as a retaining element to prevent the fitting of element 170 in a downward direction. Thus, tab V4L4 having loops disposed thereupon disposed upon portion 160 and pad V4H4 disposed upon the surface of portion 170 will, as illustrated in FIG. 11, fasten to one another and thus retain portion 170 in blocking engagement with the handle 15 of the latch mechanism as best illustrated in relation to FIG. 10. Referring to FIG. 13, the compatible shape of the blocking element at the remote portions of 170 are illustrated.

Thus, it can be seen that the blocking element may be embodied in a multiplicity of fashions and still retain the subject matter of the instant invention. It is not necessary that "Velcro" fasteners be used and any alternative fastening may be used depending on the embodiment of the blocking element and the latch upon which it is to be installed. For example, the blocking elements may be used and installed upon the controls for stove burners found within modern kitchens as a child-proof blocking element and thus preventing the rotation of the dials upon the stove. In accomplishing this task, the fasteners will be installed remote the dial fastening the blocking element to the supporting super structure for the dials and preventing the rotation of the dial by fastening of the blocking element thereto.

As many changes can be made to the preferred embodiments without departing from the scope of the invention, it is intended that all matter contained herein be interpretted as illustrative of the invention and not in a limiting sense.

The embodiments of the invention in which an exclusion property or priviledge is claimed are as follows:

1. A repositionable latch blocking means for use with latchable means, the latchable means having operating means to operate the latchable means between locked and unlocked positions, the latch blocking means comprising a unitary configuration having at least a first surface, the unitary configuration having fastening means disposed thereupon adjacent the operating means in use, to fasten the latch blocking means proximate the operating means of the latchable means, so as to position the at least first surface to block the operation of the operating means and thereby prevent the operation of the latchable means between locked and unlocked positions, whereby when the latch blocking means is repositioned, so as to position the at least first surface remote the operating means said repositioning allows the operation of the latchable means, wherein the fastening means further comprises interlocking material portions such as "Velcro".

2. The latch blocking means of claim 1 comprising a substantially planar element having an opening extending therethrough compatible with the operating means of the latching means.

3. The latch blocking means of claim 1 or 2, wherein the latch blocking means has first fastening means mounted thereupon for engagement with compatible second fastening means adjacent the operating means of the latching means.

4. The latch blocking means of claim 1 or 2 wherein the latching means comprises a lock for a door.

5. The latch blocking means of claim 3 wherein the latching means comprises a lock for a door.

6. The latch blocking means of claim 1 comprising at least a first and second planar element hingeably connected together remote the operating means in use, the first element being fastened proximate the operating means of the latching means but not engageable with the operating means, the at least a second element having the at least a first surface of the latch blocking means and being pivotable from a position remote the operating means to a position proximate the operating means, the at least first and second elements having fastening means disposed proximate their adjacent surfaces, adjacent when the at least a second element is pivoted to a position proximate the operating means, thereby engaging the at least a first surface and the operating means until such time as the at least a second element is pivoted away from the operating means.

7. The latch blocking means of claim 6 wherein the latching means comprises a lock for a door.

8. The latch blocking means of claim 1 comprising a substantially frustum shaped element, the at least a first surface being of compatible shape to engage the operating means of the latching means and thereby block the operation of the operating means until the latch blocking element is repositioned remote the operating means, the latch blocking means having first fastening means disposed about some of the surface area of the frustum shaped element, the first fastening means for engagement with second fastening means disposed proximate the operating means to maintain the blocking element in position whereby the at least a first surface of the blocking element blocks the operation of the operating means of the latching means until such time as at least a first surface of the blocking element are repositioned remote the operating means.

9. The latch blocking means of claim 8 wherein the substantially frustum shaped element has an opening disposed in the surface of the end of the element having the smaller diameter.

10. The latch blocking means of claim 9 wherein the at least a first surface of the blocking element and the opening disposed in the surface of the end of the element having the smaller diameter blocks the operation of the operating means of the latching means until such time as the at least a first surface of the blocking element and the opening are repositioned remote the operating means.

11. The latch blocking means of claim 8 wherein the latching means comprises a door knob having a centrally disposed rotatable operating means for locking and unlocking a door.

12. The latch blocking means of claim 9 or 10, wherein the latching means comprises a door knob having a centrally disposed rotatable operating means for locking and unlocking a door.

13. The latch blocking means of claim 1 comprising a substantially convex disc shaped element, the at least a first surface being of compatible shape to engage the operating means of the latching means and thereby block the operation of the operating means until the latch blocking element is repositioned remote the operating means, the latch blocking means having first fastening means disposed about some of the surface area of the convex disc shaped element, the first fastening means for engagement with second fastening means disposed proximate the operating means to maintain the blocking element in position whereby the at least a first surface of the blocking element blocks the operation of the operating means of the latching means until such time as the at least a first surface of the blocking element are repositioned remote the operating means.

14. The latch blocking means of claim 13 wherein the substantially convex disc shaped element has an opening disposed in the surface of the end of the element having the convex shape.

15. The latch blocking means of claim 14 wherein the at least a first surface of the blocking element and the opening disposed in the surface of the end of the element having the smaller diameter blocks the operation of the operating means of the latching means until such time as the at least a first surface of the blocking element and the opening are repositioned remote the operating means.

16. The latch blocking means of claim 13, 14 or 15, wherein the latching means comprises a door knob having a centrally disposed rotatable operating means for locking and unlocking a door.

* * * * *